United States Patent [19]

Miller

[11] Patent Number: 4,482,401

[45] Date of Patent: Nov. 13, 1984

[54] METHOD FOR PRODUCING CUBE-ON-EDGE ORIENTED SILICON STEEL

[75] Inventor: Robert F. Miller, Evans City, Pa.

[73] Assignee: Allegheny Ludlum Steel Corporation, Pittsburgh, Pa.

[21] Appl. No.: 551,515

[22] Filed: Nov. 15, 1983

Related U.S. Application Data

[63] Continuation-in-part of Ser. No. 399,680, Jul. 19, 1982, abandoned.

[51] Int. Cl.[3] ..... H01F 1/04

[52] U.S. Cl. ..... 148/111; 148/113

[58] Field of Search ..... 148/110, 111, 112, 113, 148/22, 27, 28

[56] References Cited

U.S. PATENT DOCUMENTS

| | | | |
|---|---|---|---|
| 3,522,108 | 7/1970 | Yamamoto et al. | 148/113 |
| 3,627,594 | 12/1971 | Yamamoto et al. | 148/113 |
| 3,647,575 | 3/1972 | Fiedler et al. | 148/111 |
| 3,700,506 | 10/1972 | Tanaka et al. | 148/111 |
| 3,765,957 | 10/1973 | Hamachi et al. | 148/113 |
| 3,959,034 | 5/1976 | Akerblom | 148/113 |
| 3,990,923 | 11/1976 | Takashina et al. | 148/111 |
| 4,200,477 | 4/1980 | Datta et al. | 148/27 |

FOREIGN PATENT DOCUMENTS

| | | | |
|---|---|---|---|
| 607851 | 12/1975 | U.S.S.R. | 148/27 |

*Primary Examiner*—John P. Sheehan

*Attorney, Agent, or Firm*—Patrick J. Viccaro

[57] ABSTRACT

An improvement in the manufacture of cube-on-edge oriented silicon steel; the improvement comprises coating the surface of the silicon steel with a manganese-bearing material prior to texture annealing, whereby secondary grain growth is inhibited during texture annealing to achieve reduced watt loss.

4 Claims, No Drawings

METHOD FOR PRODUCING CUBE-ON-EDGE ORIENTED SILICON STEEL

This is a continuation-in-part of application Ser. No. 399,680, filed July 19, 1982, now abandoned.

Cube-on-edge oriented silicon steel in the form of sheets is known for use in various electrical applications including transformer cores. With cube-on-edge silicon steel the alloy is characterized by secondary recrystallization in the (110)[001] position, which is termed the cube-on-edge position. This material in sheet form has the direction of easy magnetization in the direction of rolling. In applications for this material, and specifically when used in the manufacture of transformer cores, the material is required to have reduced watt loss, because the consumption of electrical energy decreases as iron loss decreases. Reduced watt loss may be promoted by achieving fine secondary grain size during texture annealing.

It is accordingly an object of the present invention to provide a method whereby during the texture annealing of cube-on-edge silicon steel the secondary grain growth is inhibited to provide a relatively fine grained material after texture annealing with reduced watt loss.

This and other objects of the invention, as well as a more complete understanding thereof, may be obtained from the following description and specific examples.

Broadly, in the practice of the invention a silicon steel which has been conventionally processed by hot rolling and cold rolling with intermediate anneals is surface coated with a manganese-bearing material prior to texture annealing and is texture annealed in the conventional manner with said manganese-bearing material thereon. More specifically, the invention comprises surface coating silicon steel with a manganese-bearing coating after cold rolling, and either prior to slurry coating or after slurry coating, but prior to final texture annealing. Preferably, the manganese-bearing coating is applied to spaced regions, i.e., stripes. A manganese-bearing material particularly suited for use in the invention is $Mn(NO_3)_2$. It has been found that the presence of the manganese-bearing compound during annealing inhibits secondary grain growth and thus reduces watt loss. This may be further enhanced if the steel is serrated prior to texture annealing. Although the practice of the invention finds utility with cube-on-edge oriented silicon steels generally, it is particularly adapted to steels of this type within the following composition limits in percent by weight:

| Steel | Mn | C | S | Si | B | Fe |
|---|---|---|---|---|---|---|
| SX-14 | .025-.045 | .020-.060 | .005-.040 | 2.70-3.50 | .0005-.0030 | Bal. |
| SX-11 | .050-.080 | .020-.060 | .020-.035 | 3.00-3.70 | — | Bal. |

By the practice of coating steel with a manganese-bearing compound and texture annealing with the compound being present on the steel, said practice is believed to be effective for the purpose by diffusing manganese into the steel during annealing, which promotes primary grain coarsening by interaction with the solute sulfur, which sulfur would tend to inhibit grain growth. Hence a region is provided in which primary grain growth occurs and restricts the growth of secondary grains through this region. It would appear that the extent of grain refinement of the secondary grains after texture annealing depends on the spacing of the regions of primary grain growth on the areas of application of the manganese-containing material, provided that the width of the treated region is sufficient to act as a barrier to the secondary grains. This effect may be supplemented by creating similar barriers by subjecting the steel to serrating or the like.

The silicon steel composition used in the specific examples, and identified as SX-14, was of the following nominal composition in percent by weight:

| Mn | S | C | Si | B | Fe |
|---|---|---|---|---|---|
| .035 | .016 | .030 | 3.15 | .0010 | Balance |

Epstein packs of final normalized SX-14 composition, identified as Heat No. 154684, were coated with a water slurry comprising 300 cc of water, 46 gm. of MgO and 2 gm. of $H_3BO_3$. This material with the coating thereon was then texture annealed in a hydrogen atmosphere in the conventional manner. Specifically, the texture annealing consisted of charging the material into a furnace at a temperature of 1400° F., heating at a rate of 50° F. per hour to a temperature of 2150° F., holding at temperature for 12 hours and then cooling to 1200° F., at which time the material was removed from the furnace. One of the Epstein packs, prior to the above slurry coating, was painted with a mixture of 30 cc of 50% $Mn(NO_3)_2$ and an inert thickener, which was applied in 1 mm stripes perpendicular to the sheet rolling direction at intervals of 10 mm; this painted coating was then air dried. This Epstein pack constituted treatment in accordance with the practice of the invention; whereas, the second pack was used as a control and typified a conventional practice. Following the texture annealing procedure, as described above, the average lineal dimension of the secondary grains of the conventional, control pack specimen in the sheet rolling direction was 13 mm. In contrast, the average lineal dimension of the secondary grain of the specimen treated with $Mn(NO_3)_2$ in accordance with the practice of the invention was 7 mm; these grains it was observed were often separated by the aforementioned bands of smaller primary grains where normal grain growth was stimulated by the application of the manganese-bearing compound.

In a second specific example, a single Epstein strip of final normalized SX-14 composition from the same heat as in the aforementioned Example 1 was scribed with a metal scribe to produce serrations in the strip perpendicular to the rolling direction at intervals of 10 mm. After the scribing operation, the strip was slurry coated and texture annealed under the conditions described above with respect to the first specific example. Following this texture annealing, the average lineal dimension in the sheet rolling direction of the secondary grain in the scribed strip was 9.5 mm.

I claim:

1. In a method for producing cube-on-edge oriented silicon steel, characterized by reduced watt loss, including the steps of hot-rolling, cold-rolling with intermediate annealing, slurry coating and a final texture annealing, the improvement comprising surface coating spaced regions of said steel with a manganese-bearing material after cold rolling and prior to texture annealing and texture annealing said steel with said manganese-bearing coating thereon for manganese to interact with solute sulfur in the steel, whereby secondary grain growth is inhibited during texture annealing.

2. The method of claim 1 wherein said manganese-bearing material is $Mn(NO_3)_2$.

3. The method of claim 1 includes surface coating spaced regions of steel prior to slurry coating and texture annealing.

4. The method of claim 1 including surface coating spaced regions of steel after slurry coating, but prior to texture annealing.

* * * * *